US007614534B2

(12) United States Patent
Veo et al.

(10) Patent No.: US 7,614,534 B2
(45) Date of Patent: Nov. 10, 2009

(54) FIREARM MAGAZINE RETENTION AND DELIVERY SYSTEM

(76) Inventors: Justin K. Veo, P.O. Box 283, Red River, NM (US) 87558; Joseph G. Koch, P.O. Box 571, Red River, NM (US) 87558

( * ) Notice: Subject to any disclaimer, the term of this patent is extended or adjusted under 35 U.S.C. 154(b) by 754 days.

(21) Appl. No.: 10/986,632

(22) Filed: Nov. 12, 2004

(65) Prior Publication Data

US 2005/0230411 A1 Oct. 20, 2005

Related U.S. Application Data

(60) Provisional application No. 60/519,287, filed on Nov. 12, 2003.

(51) Int. Cl.
*F42B 39/02* (2006.01)

(52) U.S. Cl. ..... 224/196; 224/239; 224/247; 224/931

(58) Field of Classification Search ..... 224/196, 224/195, 660, 667, 678, 682, 236, 239, 240, 224/241, 247, 248, 931, 462, 680, 242; 206/3; 42/87

See application file for complete search history.

(56) References Cited

U.S. PATENT DOCUMENTS 1,756,677 A * 4/1930 Cook ..... 224/245
2,271,262 A * 1/1942 Johnson ..... 24/3.1
4,299,344 A * 11/1981 Yamashita et al. ..... 224/242
5,174,482 A * 12/1992 Rogers et al. ..... 224/239
5,187,744 A * 2/1993 Richter ..... 379/449
D346,275 S * 4/1994 Hayasaka et al. ..... D3/218
5,370,622 A * 12/1994 Livingston et al. ..... 604/151
5,699,943 A * 12/1997 Schaefer et al. ..... 224/197
6,050,464 A * 4/2000 Ramsey et al. ..... 224/196
6,154,997 A * 12/2000 Aluotto et al. ..... 42/90
D508,313 S * 8/2005 Cullen et al. ..... D3/203.7
7,025,238 B2 * 4/2006 Hughes et al. ..... 224/671
7,194,837 B2 * 3/2007 Obong ..... 42/90

* cited by examiner

*Primary Examiner*—Nathan J Newhouse
*Assistant Examiner*—Corey N Skurdal
(74) *Attorney, Agent, or Firm*—Rod D. Baker

(57) ABSTRACT

A method and apparatus for retaining one or more magazines, such as those used in conjunction with firearms. The apparatus of the present invention retains the magazine in a secure manner while enabling a user to rapidly remove the magazine with little effort. The apparatus is preferably made from a rigid material. In one embodiment one or more of the sides of the housing of the magazine retainer are hingable. In another embodiment, one or more of the sides is flexible. The present invention also preferably provides an oversized floor-plate for the magazine, thus providing the user with a larger gripping surface and thus facilitating extraction of the magazine from the retainer.

20 Claims, 15 Drawing Sheets

FIREARM MAGAZINE RETENTION AND DELIVERY SYSTEM

This application claims the benefit of the filing of U.S. Provisional Patent Application Ser. No. 60/519,287 entitled "Firearm Magazine Retention and Delivery System", filed on Nov. 12, 2003, and the specification thereof is incorporated herein by reference.

BACKGROUND OF THE INVENTION

1. Field of the Invention (Technical Field)

The invention relates to firearms, particularly ammunition magazines, and relates specifically to an apparatus for securely but releasably holding multi-round handgun ammunition magazines on the belt of a user.

2. Description of Related Art

There is an unmet need for a method or apparatus for holding extra handgun ammunition "clips" or magazines at the ready for use by military and law enforcement personnel.

Conventionally, spare magazines are typically transported and carried on the person of the user by means of a pocket or pouch attached to the user's belt. The pouch often is made of a pliable leather or flexible canvas, nylon or fabric material. Rigid plastic pouches are also known in the art. A problem with typical pouches currently in use is that easy or rapid removal of a magazine is not possible. This is due to at least two factors.

First, the pouches are often constructed such that their internal dimensions closely match the outside dimensions of a magazine, thus creating a frictional fit throughout the entire length of the magazine. A user wishing to remove a magazine from such a pouch must therefore exert substantial force to free the magazine. The second factor that substantially contributes to the inability to rapidly remove a magazine from pouch holders is much more apparent in those pouches made from flexible or semi-flexible material. The material of the pouch, being pliable in nature, tends simply to bend in the direction of, and follow, any force used to remove the magazine. Thus, a user wishing to remove a magazine from such a pouch must pull the magazine through a greater distance because the pouch has the tendency to simply follow and stick to the magazine. The excessive force needed to overcome the friction of these pouches, as well as the excessive movement required during such removal, results in increased time required to free a spare magazine from a pouch.

Also, with current devices, security of the ammo magazine within a pouch may be provided by means of a closure component, such as a flap with any of a variety of "snaps" or other fasteners. Thus, a flap or lid covers the open end of the pouch to hold the magazine within the pouch, and the user must unfasten the flap to access the magazine. While these known closure means provide reliable closure of the pouch against the inadvertent loss of a magazine, they are somewhat cumbersome to open and close, especially when the user is in a hurry or in the dark.

For some users, the problems associated with the reduced ability to quickly access a magazine creates little more than frustration and annoyance. However, for users in military, law enforcement, or security roles, the inability to quickly remove a spare magazine can be the deciding factor between life and death. In 2002, 153 officers were killed in the line of duty. Many more were severely injured. In several of these instances, the ability of the officer to quickly reload and draw his weapon could have resulted in a decidedly different outcome. There is thus a present need for a method and apparatus which will allow for the secure retaining of spare magazines on the user, without compromising rapid access thereto.

BRIEF SUMMARY OF THE INVENTION

A primary object of the present invention is to securely retain one or more magazines, for example on a user's belt, while simultaneously providing for their rapid removal.

The present invention includes a magazine retaining apparatus having one or more housings. Each of the housings has a base-plate, an end-plate, and two side-plates. At least one of the side-plates is hingedly connected to the base-plate. One or more springs are disposed so as to cause the pivotal side-plate to resist a rotational force applied in a direction away from the other side-plate. "Springs" include any suitable biasing device, such as coil springs, torsion bars, or leaf springs.

One or more of the retaining apparatuses can be fastened to a mounting-plate. The apparatus of the present invention also preferably has a magazine floor-plate with a large protruding front portion, a void disposed through the floor-plate, and one or more grooves disposed on one or more side portions of the floor-plate.

The side-plates preferably have one or more recesses and or projections disposed on an inner surface thereof. It is further preferable that interfacing lips on the side-plates define an hourglass-shaped void.

It is also preferable that the apparatus of the present invention have a fastening feature. It is further preferable that the fastening feature be one or more clips, one or more straps or thongs, one or more elastic bands, a paddle for inserting between a waist of the user and his pants, a hollow structure for placing a belt through, or a combination thereof.

The present invention also relates to an apparatus having one or more housings, each of the housings having a base-plate, an end-plate, and two side-plates, at least one of the side-plates has a flexible material, the flexible side-plate is rigidly connected to the base-plate. The apparatus can also have a mounting-plate and or a magazine floor-plate. The magazine floor-plate can have a large protruding front portion, a void disposed through it, and or one or more groves on one or more sides thereof.

The side-plates of the apparatus can have one or more recessions and or one or more projections disposed on an inner surface thereof. The side-plates comprise an interfacing region. The interfacing region of the side-plates preferably has an hour-glass shape.

It is further preferable that the apparatus have a fastening apparatus which can be one or more clips, one or more straps or thongs, one or more elastic bands, a paddle for inserting between a waist of the user and his pants, a hollow structure for placing a belt through, or a combination of these. In an embodiment using a hollow structure for placing a belt through, the fastening apparatus preferably comprises at least one tensioner to secure the fastening apparatus to a user's belt. The fastening apparatus may also comprise a storage component to house a tool to work on the tensioner. The apparatus may also comprise at least one tensioner disposed on the base-plate to adjust slack.

The present invention also relates to a method for retaining a magazine, having the steps of providing a base-plate, providing an end-plate, providing two side-plates, hingedly connecting at least one side-plate to the base-plate, and providing a magazine. The method can also have the steps of providing a mounting-plate, providing a magazine floor-plate, providing one or more fastening apparatuses, as well as providing one or more springs.

The present invention also relates to a method for retaining a magazine having the steps of providing a base-plate, providing an end-plate, providing two side-plates, at least one of the side-plates having a flexible material, and rigidly connecting the side-plate the base-plate. The method can also have the steps of providing a mounting-plate, providing a magazine floor-plate, providing one or more fastening apparatuses as well as providing one or more springs.

A primary advantage of the present invention is that methods and apparatuses are provided which securely retain a magazine while simultaneously providing for their rapid removal.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out herein.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1A:
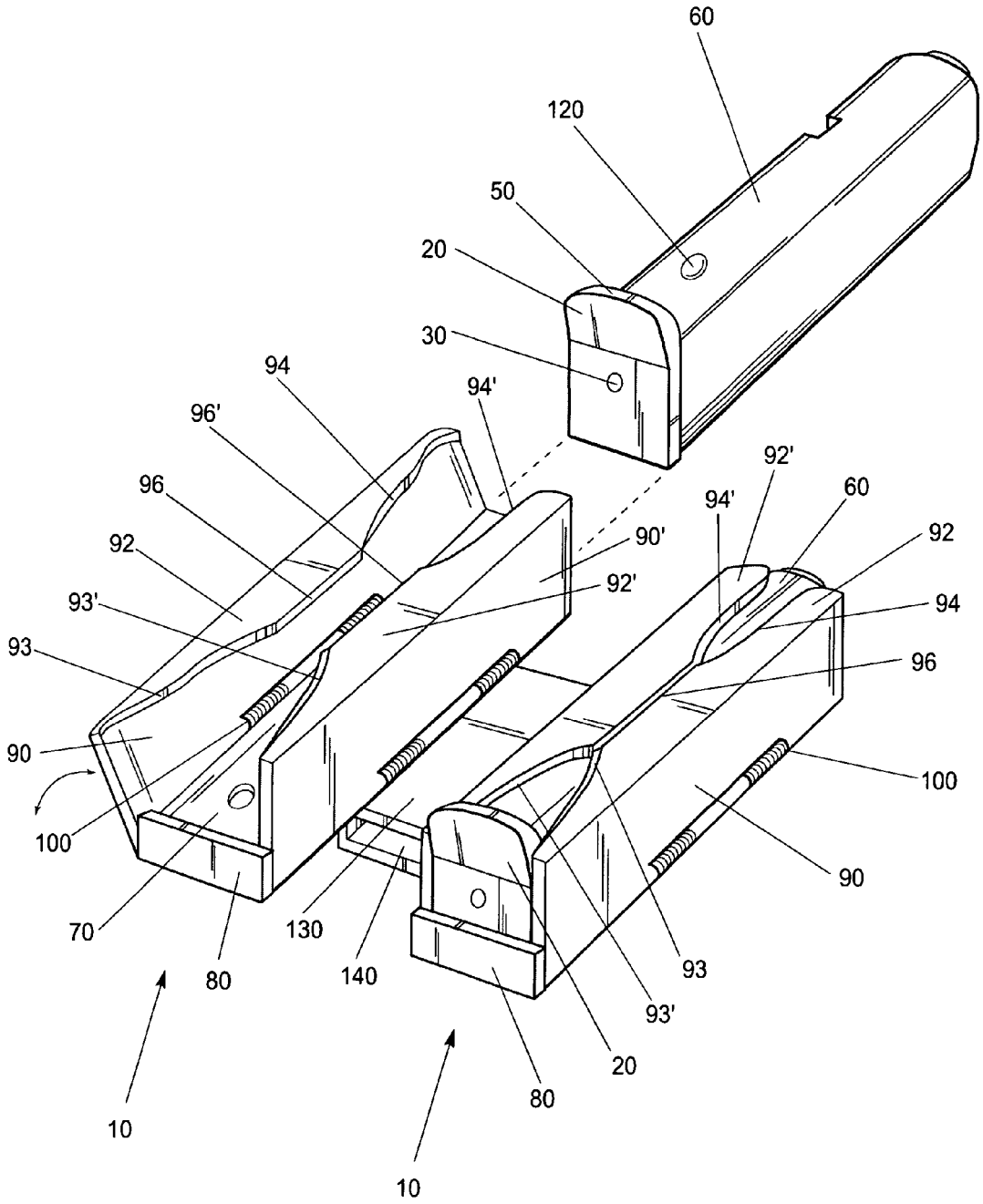
FIG. 1A is a perspective, partially exploded view of an embodiment of the present invention, shown with an ammunition magazine.

The present invention is directed to a method and apparatus for securely retaining on the person of a user one or more ammunition magazines, e.g. a multi-round handgun ammo "clip," while also permitting for their rapid removal. Particularly, the present invention relates to a method and apparatus which enables one or more ammunition magazines to be retained with the aid of a magazine housing having a spring-loaded component. The housing preferably is attachable to the user's belt.

The term "magazine" as used throughout the specification and claims is intended to include all firearms magazines and clips. Ordinarily, multi-round clips are removably insertable into the handle or handgrip of the weapon (most commonly semi-automatic pistols, such as Baretta®, Glock®, and SIG® brand handguns).

Referring now to all the figures collectively, the present invention is a magazine retainer having one or more housings 10 and preferably a corresponding number of magazine butt plates or floor-plates 20. The invention may be provided in the form of an after-market kit, in which the user is able to customize his ammunition magazines for use. In such a kit may be provided several, for example three, floor-plates 20 allowing the user to interchange three magazines between the inventive retainer unit and the user's handgun. Moreover, a user may be provided with several floor-plates 20 adapted to be fitted to particular brand-name magazines, allowing a user to utilize the invention with a variety of different firearms, a magazine being removably insertable into a corresponding housing 10.

Preferably, floor-plate 20 and the elements of the housing 10 are made from a rigid and durable plastic or composite material, including but not limited to ABS, Nylon® polymer and/or Kevlar® polymer. Floor-plate 20, including aperture 30 and grooves 40, preferably is constructed to mate with a particular style and/or size of magazine 60, and may be customized to attach to the magazine of a particular model and brand of firearms manufacturer.

Figure 5:
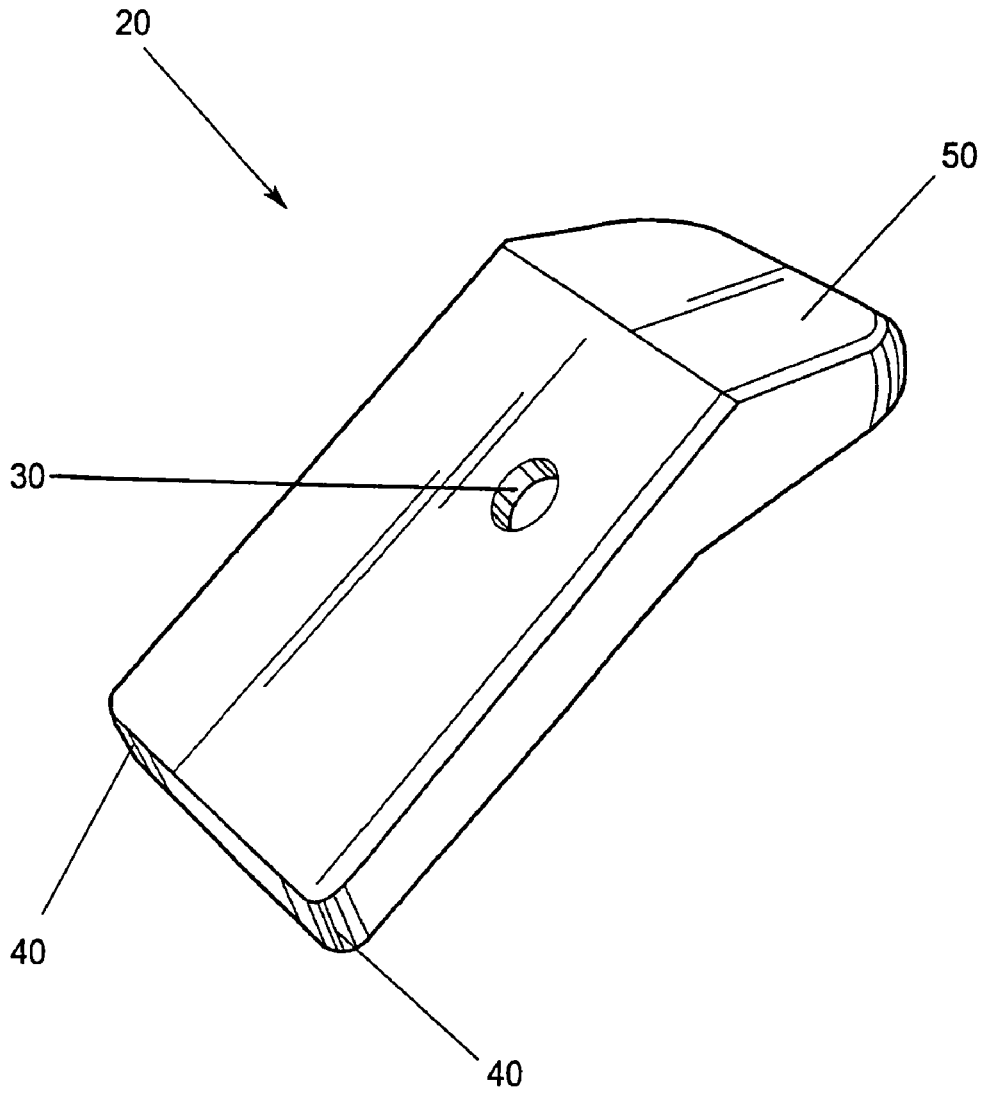
FIG. 5 is an enlarged perspective side view of a floor-plate component of the present invention.
Figure 7:
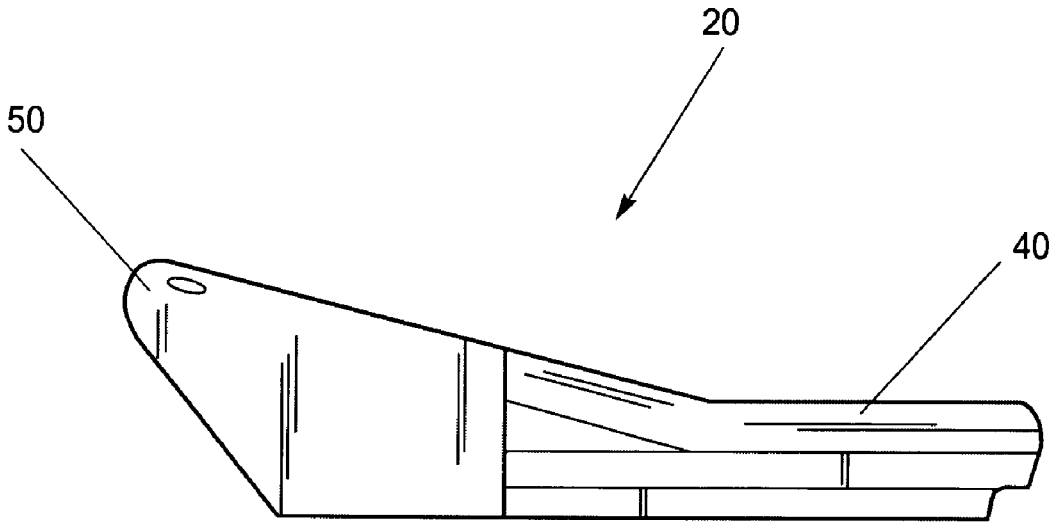
FIG. 7 is a partial sectional side view of the floor-plate of the present invention.
Figure 10:
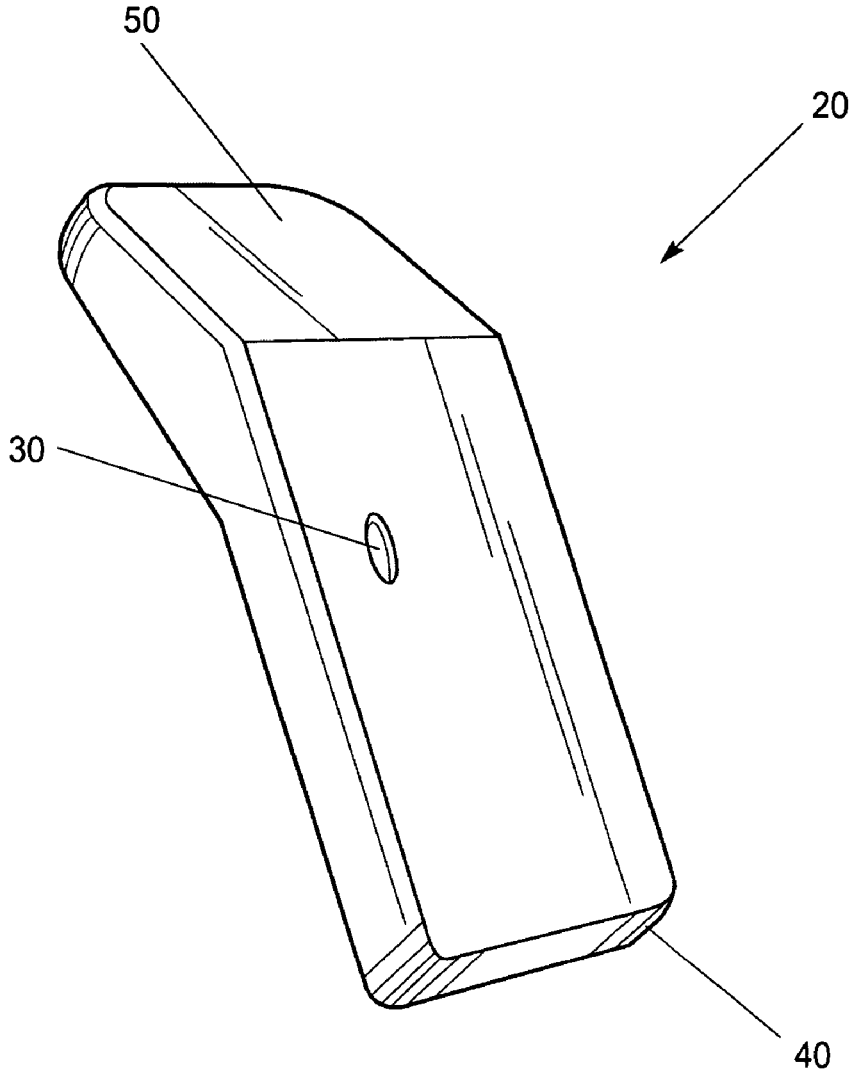
FIG. 10 is a perspective end view of a floor-plate component according to the apparatus of the present invention.

Floor-plate 20 defines a fastener aperture 30 there through for facilitating connection of the floor-plate to the original equipment manufacturer's magazine 60. Most magazines feature a spring-biased detent thereon which springs into place into the aperture 30 when the floor-plate 20 has been slipped into proper position upon the end of the magazine. To install a floor-plate upon a magazine, the interior grooves 40, which are in confronting parallel opposition on the inside face of the floor-plate, are mated with corresponding flanges or ridges on the magazine, and the floor-plate is slid along the magazine flanges until the magazine detent pops into the fastener aperture 30, at which point the floor-plate is secured in position. Thus, floor-plate 20 typically attaches to magazine 60 by the use of fastener aperture 30 and interior groove 40 (FIGS. 5, 7 and 10). The interior groove 40 is sized and configured to slidably receive a longitudinal flange or lip the commonly runs along the edge of commercially available ammunition magazines. In the practice of the invention, a magazine 60 is purchased off-the-shelf, and the original stock butt-plate thereof is removed and replaced with the floor-plate 20 of the invention. The floor-plate 20 is slipped onto the magazine by sliding the magazine lip or ridge into the interior groove or channel 40. (The floor-plate can be removed, if desired, by depressing the magazine detent with the tip of a pointed tool, and with the detent depressed sliding the floor-plate off the magazine.)

Certain brands and varieties of off-the-shelf magazines may require the use of a fastener such as a rivet or screw for attaching the floor-plate 20 to an end of the magazine 60, in which instances the aperture 30 can accommodate the need, i.e., a rivet or screw is inserted through the fastener aperture 30.

The attachment of a floor-plate 20 to a magazine 60 in this manner is an almost uniform practice among various types, calibers, and brands of firearms. The present invention can readily be adapted by one skilled in the art to produce other configurations of floor-plate 20 which will enable such floor-plates to attach to other designs of magazines. It is preferable that floor-plate 20 and the components of housing 10 be made from a substantially rigid material such as a metal, metal-alloy, synthetic polymer or composite material. Magazines from the original equipment manufacturer are equipped with a butt or floor-plate, but it is contemplated that the original equipment floor-plate is replaced with a specialized floor-plate 20 according to the invention—particularly a floor-plate that has a front portion 50 that extends in a manner apparent from the description below.

The preferred embodiment of the invention features two identical, parallel, housings 10, 10' on a mounting plate 130 (the base-plate 70 of a housing being attached to the mounting plate), although an embodiment having a single housing is within the scope of the invention.

Floor-plate 20 preferably has large protruding front portion 50, which affords the user a larger surface to grasp when removing magazine 60 from housing 10. It is important to note, however, that floor-plate 20 is only a preferred embodiment for using the invention and as such is not essential for the operation of the present invention. Rather, a standard magazine can be used and can still produce desirable results.

Figure 6:
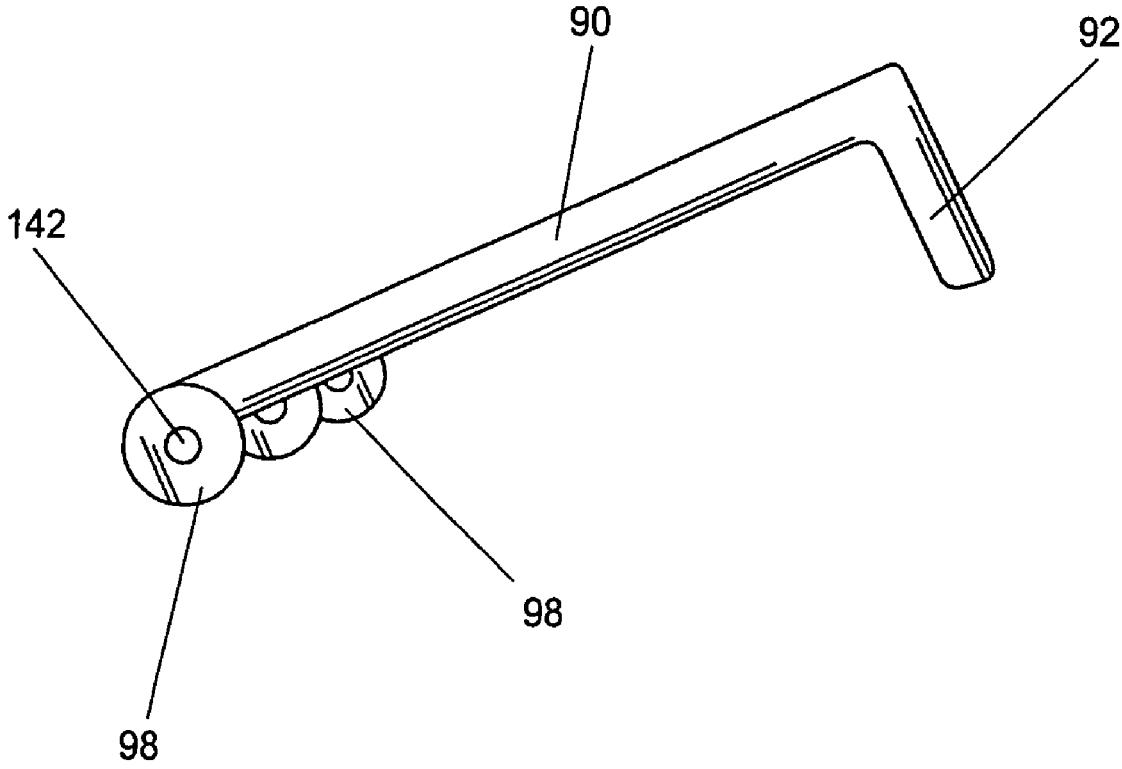
FIG. 6 is an end view of a side-plate of an embodiment of the present invention.

Each housing 10 has base-plate 70, an end-plate 80, and two (left and right) side-plates 90, 90'. In one embodiment, one of side-plates 90 or 90' is hingedly connected to base-plate 70. For purposes of discussion herein, where only one of either side-plate 90 or side-plate 90' is hinged, side plate 90 is discussed as representative of such an embodiment. A rod or wire (not shown) may form the pin to interconnect the interleaved knuckle portions 72, 98 (FIGS. 1C 4, 8, and 9) of the adjacent plates 70, 90 to define a hinge of generally conventional configuration. However, a spring 100 (FIGS. 1 and 3) is disposed to complete the hinged attachment between a side-plate 90 and the base-plate 70. A pin, if used, resides within hollow shaft 142 (FIG. 6) of side-plate 90. The pin can be made from any of the materials which are commonly used to produce small hinges, however it is preferred that the material for the shaft of the present invention be a metal.

Figure 3:
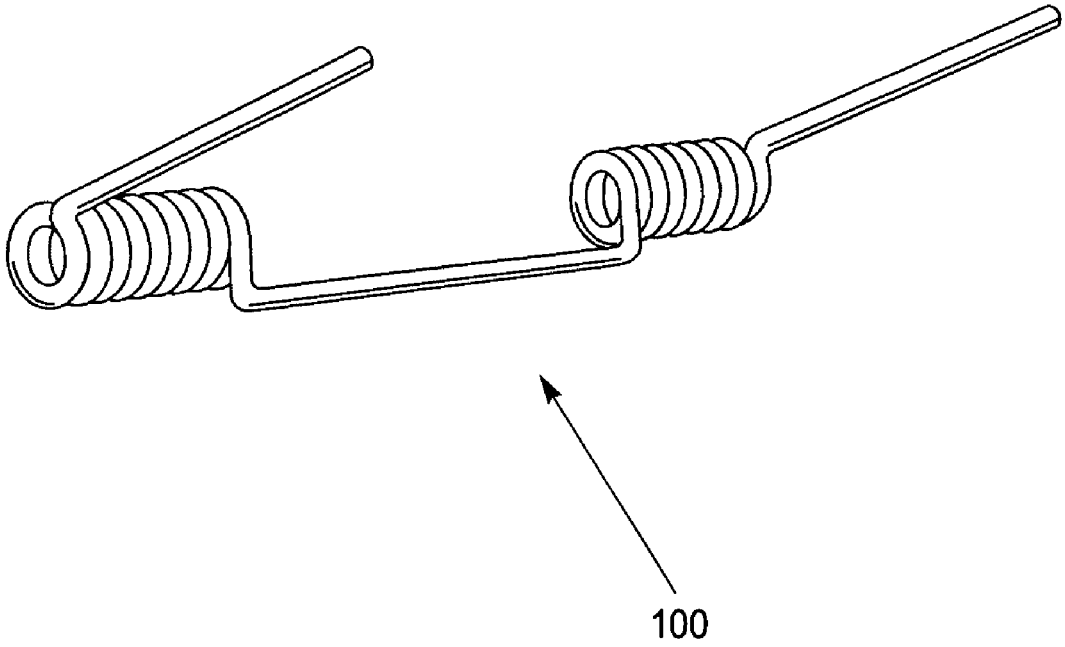
FIG. 3 is an enlarged perspective drawing of a torsion spring as a possible component of the present invention.

Alternatively, spring 100 may be integral with the hinge pin, and an acceptable torsion spring for this purpose is shown in FIG. 3. The aspect of the invention in this regard is that at least one side plate 90 has a hinged connection to base-plate 70, with the "knuckles" of the hinge defined in adjacent edges of side-plate 90 and base plate 70, which edges are placed in aligned registration and the spring 100 providing a bias urging side-plate 90 to a perpendicular position in relation to base-plate 70. The ends of the spring may be inserted into holes in the side-plates 90, 90'. The coiled portions of the spring 100 are received within corresponding recesses between the knuckles 72 (in the vicinity of the dovetail projections 77) on the base plate 70 (FIG. 8).

As indicated by the double-ended directional arrow in FIG. 1A, therefore, at least one of—and in the preferred embodiment both—side plates 90, 90' is pivotal with respect to base-plate 70. Side-plate 90 may swing out, against the bias of torsion spring 100, to increase the distance between side-plates 90, 90'; upon the release of pivoting force, the bias of spring 100 returns side-plate 90 to its rest position, at right angles to base-plate 70. Further inward pivoting of side-plate 90 is prevented by the contact of the mutual intermediate edges 96, 96' of upper lips 92, 92' of side plates 90, 90' (FIG. 1A). Torsion spring 100 thus enables hingedly connected side-plate 90 partially to resist rotational movement, as well as to enable side-plate 90 to return to a substantially 90-degree relationship with base-plate 70, after outward rotational movement has occurred. Accordingly, a spring in operative connection with one or both said side plates 90, 90' causes the either side-plate to resist a rotational force applied thereto in a direction away from the other side-plate.

Figure 4:
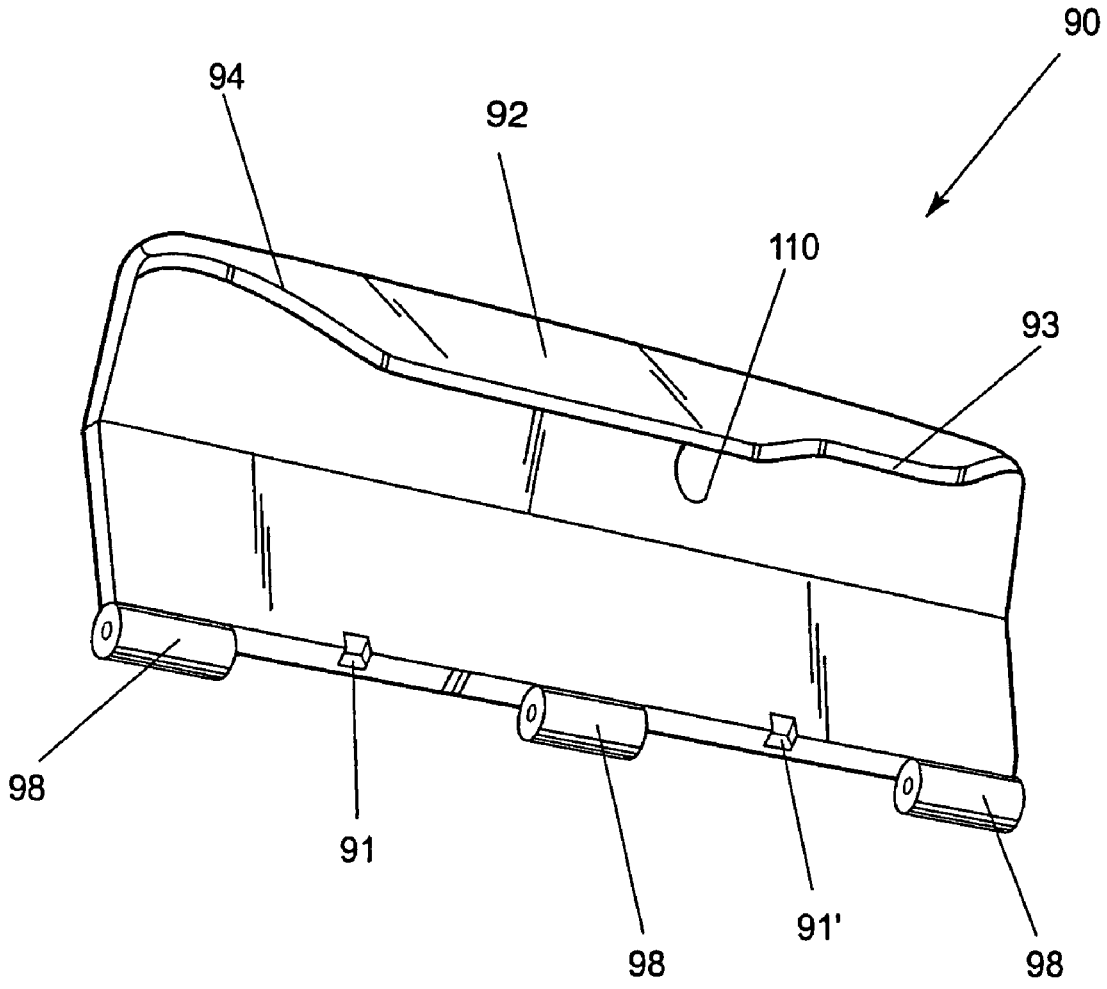
FIG. 4 is a perspective view of a right-side wall of the present invention.
Figure 9:
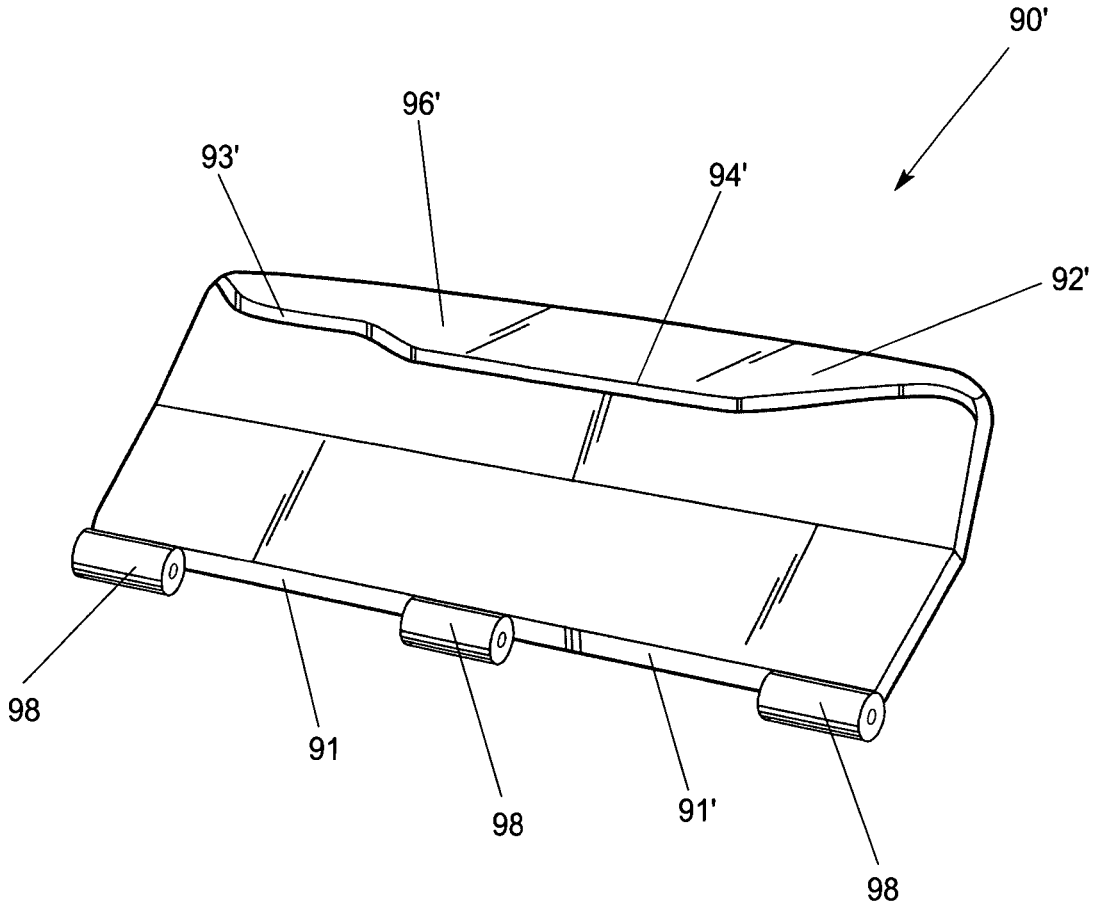
FIG. 9 is a perspective view of a left side-plate component according to the apparatus of the present invention.

As best depicted in FIG. 3, spring 100 preferably is dual torsion, i.e. it has two oppositely wound coils (FIG. 3). (One of the coils is preferably wound clockwise while the other is wound counter-clockwise.) When spring 100 is properly disposed and side-plate 90 is pivoted outwardly to an open position, both coils of spring 100 tighten. It is also preferable that the ends of spring 100 reside within hollow recesses of each side-plate 90 or 90'. In this embodiment the opposite side-plate 90 or 90' is preferably rigidly secured, in a substantially 90-degree relationship, to base-plate 70. Referring to FIGS. 4 and 9, it is seen that the each side plate 90 and 90' may be provided with small sockets 91, 91' to receive prongs from, or the bent ends of, the spring 100 whereby spring bias can be transmitted to the side-plate.

Figure 8:
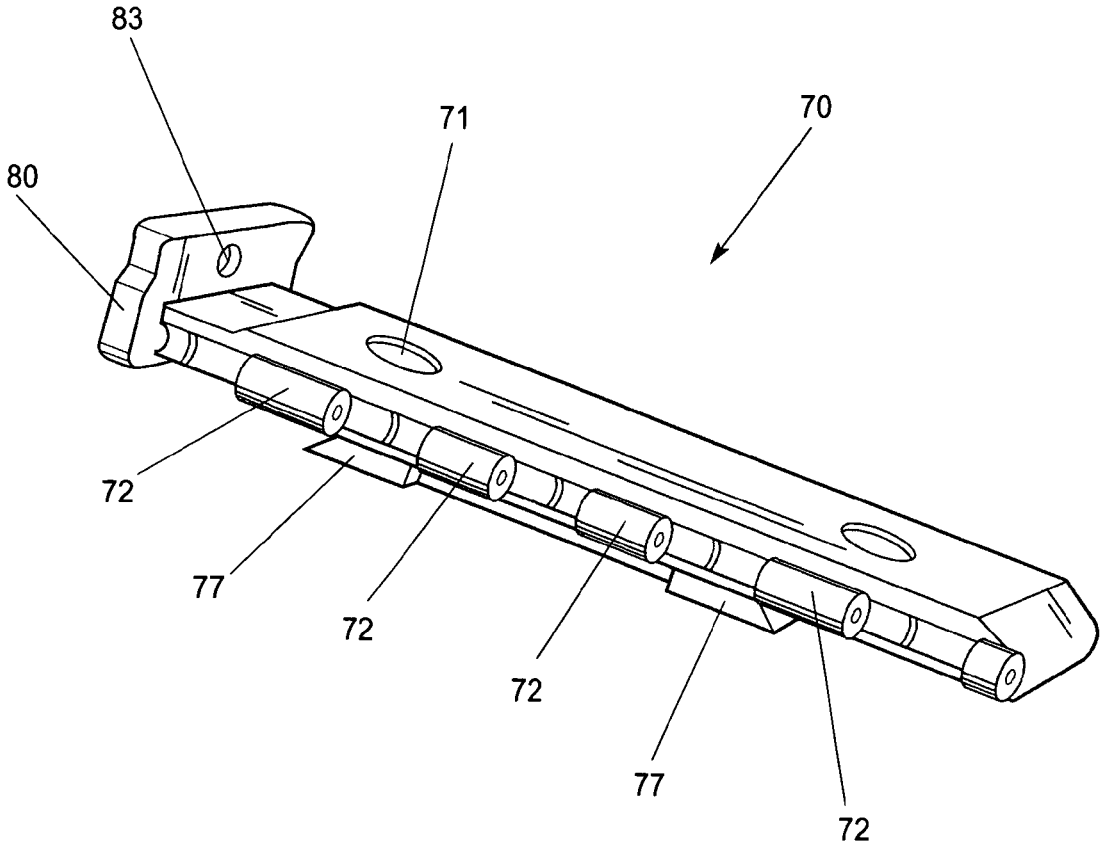
FIG. 8 is a perspective side view of the base-plate and end-plate components of the present invention.

The base-plate 70 is depicted in FIG. 8. The base-plate 70 is provided with hinge knuckles 72 along one or both longitudinal edges (depending on whether one or both side plates 90, 90' are hingedly connected thereto to pivot in relation to the base plate).The base plate 70 optionally has rivet holes 71 for fastening the base plate 70 to the mounting plate 130. Dovetail projections 77 may extend from between knuckles 72 for engagement with corresponding notches in the mounting plate 130 of the belt mount 180 to reinforce the connection therewith.

Continued reference is made to FIG. 8. The end-plate 80 if, used, is rigidly secured to an end of the base-plate 70. The end-plate optionally is provided with an adjustment screw aperture 83, through which an adjustment screw may be threadably disposed.

In the most preferred embodiment, both side-plates 90, 90', instead of just one, are hingedly connected to base-plate 70. It is preferable that both of the hingable interfaces make use of spring 100 as previously described.

In alternative but less desirable embodiments, one or both side-plates 90, 90' is rigidly secured to base-plate 70. In such an embodiment, rigidly secured side-plate 90 or 90' preferably is made from an elastically deformable material so that side-plate 90 or 90' can flex outward when sufficient force is exerted thereon in an outwardly direction. While a number of materials exhibiting a sufficient elastic deformation region (in stress/strain diagrams) thereof will be readily recognized by those skilled in the art, such materials may include, but are not limited to, ABS plastic, nylon, as well as beryllium-containing metal alloys.

In all the aforementioned embodiments, the present invention preferably has end-plate 80 disposed at an end of housing 10, as depicted in FIGS. 1A, 1B, 1C and 2A. A primary function of end-plate 80 is to prevent magazine 60 from sliding out the corresponding end of a housing 10. Having this as its primary objective, end-plate 80 need not be plate-shaped. Rather, a projection of any shape sufficient to contact floor-plate 20, and thus prevent magazine 60 from sliding out of housing 10 can be used. Therefore, while it is preferable that end-plate 80 be secured to base-plate 70, desirable results can also be achieved with projections extending from either one or both of side-plates 90, 90'.

Figure 1B:
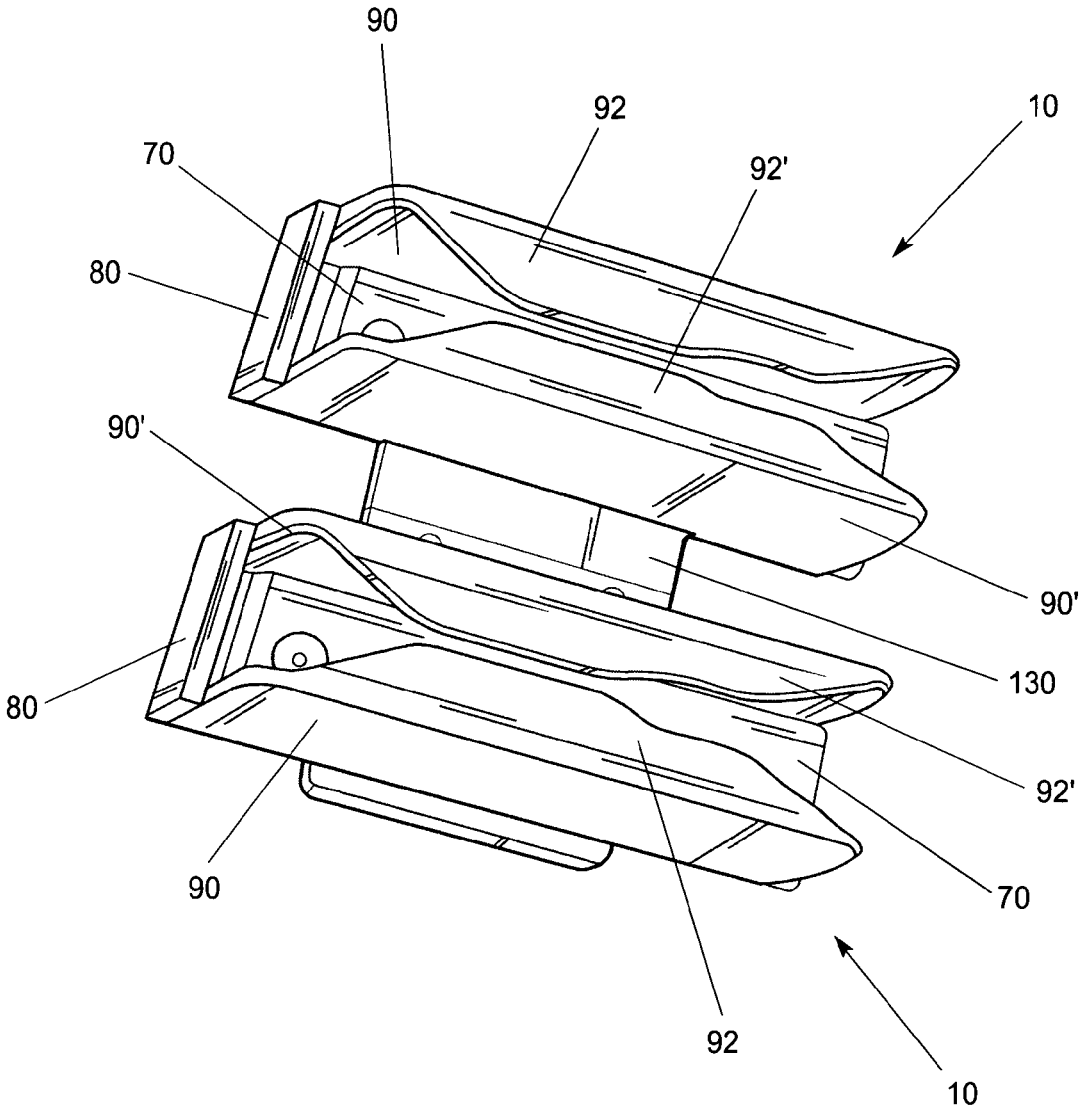
FIG. 1B is a front perspective view, of a preferred embodiment of the apparatus according to the invention.

Side-plates 90, 90' preferably have specially shaped lips 92, 92' extending perpendicularly inward from the respective upper edges of side-plates 90, 90', as seen in FIGS. 1A, 1B, 1C and 2A, to form an hourglass-shaped void between the lips 92, 92'. The side plates 90 and 90', particularly their respective inside surfaces, are shown individually and in isolation in FIGS. 4 and 9. Lips 92, 92' are essentially identical except to be reverse "mirror" images of each other. As depicted in FIGS. 1A and 1B (especially the right-side housing 10 in FIG. 1A), the medial portions of the respective lips 92, 92' extend laterally inward further from the side plates, than do the end portions of the lips, with the overall lip edges defining gracefully transitional curves. When medial edges 96, 96' of lips 92, 92', respectively, are in contact (when the housing 10 is "closed") the confluence of proximate lip edges 93, 93', and distal lip edges 94, 94', and the medial lip edges 96, 96', defines a generally hourglass-shape void or space between the lips 92, 92', as seen in FIGS. 1A and 1B. This is the "rest" or closed position of side-plates 90, 90'. This substantially hourglass-shaped configuration enables magazine 60 to be inserted into housing 10 with little force, while at the same time providing sufficient friction to prevent accidental removal of magazine 60.

Each side-plate 90, 90' optionally (but not necessarily) has a detent or recess 110 (FIG. 4) disposed on the inside surface of lip 92 or 92'. Recess 110 is defined in the underside of each lip 92 or 92' in a location to mate with a corresponding projection 120 of magazine 60, when magazine 60 is properly seated within housing 10. Side-plates 90, 90' are customized by providing recess 110 at the location suited to receive the particular make/model of magazine. Further, in some embodiments, more than one recess 110 may be provided so that a given housing 10 can receive and retain more than one type of magazine 60. Further, because some magazines may have a recess, rather than the projection depicted in the drawings, recess 110 can instead be a projection so disposed as to mate with a recess in magazine 60.

Figure 2:
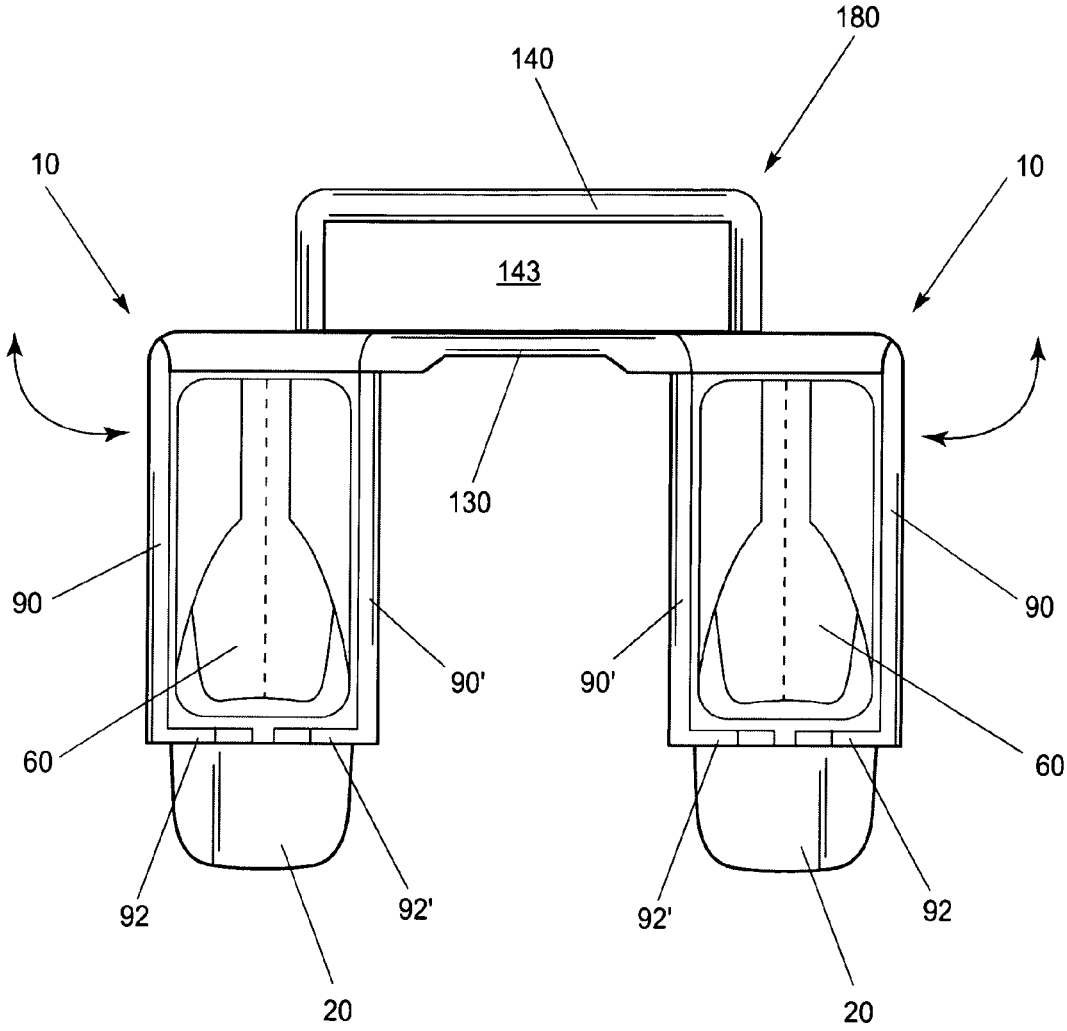
FIG. 2 is a view of one end of an embodiment of the present invention, having two magazines disposed within.
Figure 2A:
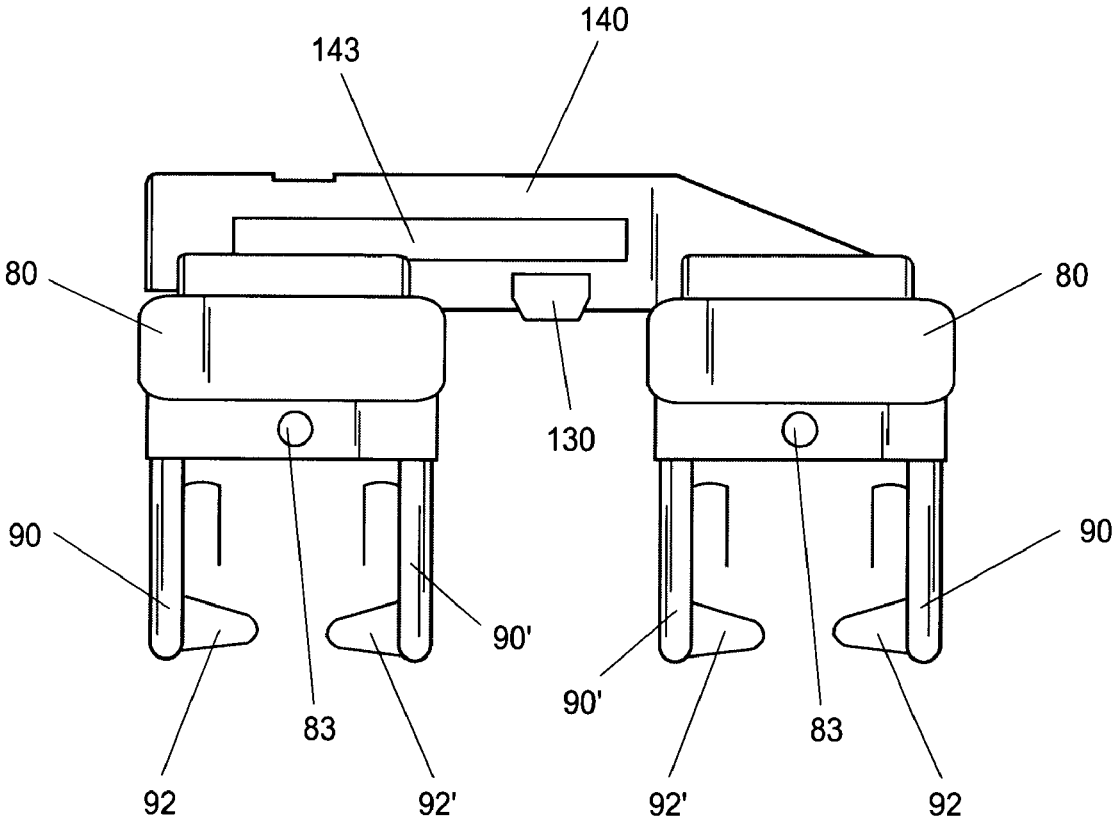
FIG. 2A is view of the other end of another embodiment of the apparatus similar to the embodiment shown in FIG. 2.

At least one housing 10 is secured to mounting-plate 130 (FIG. 2). The mounting plate is part of a preferred belt mount 180 seen in FIG. 1D. The connection preferably is established by a dovetail-like fitting of a base-plate 70 into a correspondingly shaped and sized relief or depression in the mounting plate, the connection being secured by an adhesive or rivets or other suitable means. Mounting-plate 130 may be made from a substantially rigid material such as, for example, a metal, metal-alloy, synthetic material, composite material, or combinations thereof. It is further preferable that mounting-plate 130 be made from a rigid and durable plastic or composite material. The loop-plate 140 may have access holes 147 there through, as well as a broad, flat, depressed facet 148 for the location of instruction labels, trademarks, advertisements, or the like. Fastener holes 149 promote attachment of the belt mount 180 to the base plates 70 of the housings 10.

Mounting-plate 130 is attached to a device or mechanism which would enable the apparatus of the present invention to be transported upon the user's self, clothing, or an accessory. Attachment devices and mechanisms which could be used are virtually limitless. For example, such attachment devices and mechanisms could include but are not limited to a clip, one or more straps or thongs for tying around a body part, one or more elastic bands for placing around a body part, or a paddle for inserting between the waist of the user and the user's pants (as in common in the art).

However, it is preferable that mounting-plate 130 of the present invention combine with a loop-plate 140 to define a hollow structure, thus allowing a belt of the user to pass through opening 143. It is still further preferable that orientation of opening 143 be such that magazines 60 disposed within housings 10 reside substantially parallel to the belt of the user so that magazines 60 reside in a substantially horizontal manner when the user is standing. This helps to prevent side-plates 90 from accidentally opening when a user, wearing the present invention on a belt, brushes against an object. Nevertheless, an alternative embodiment may situate magazines 60 perpendicular to the user's belt.

Figure 11:
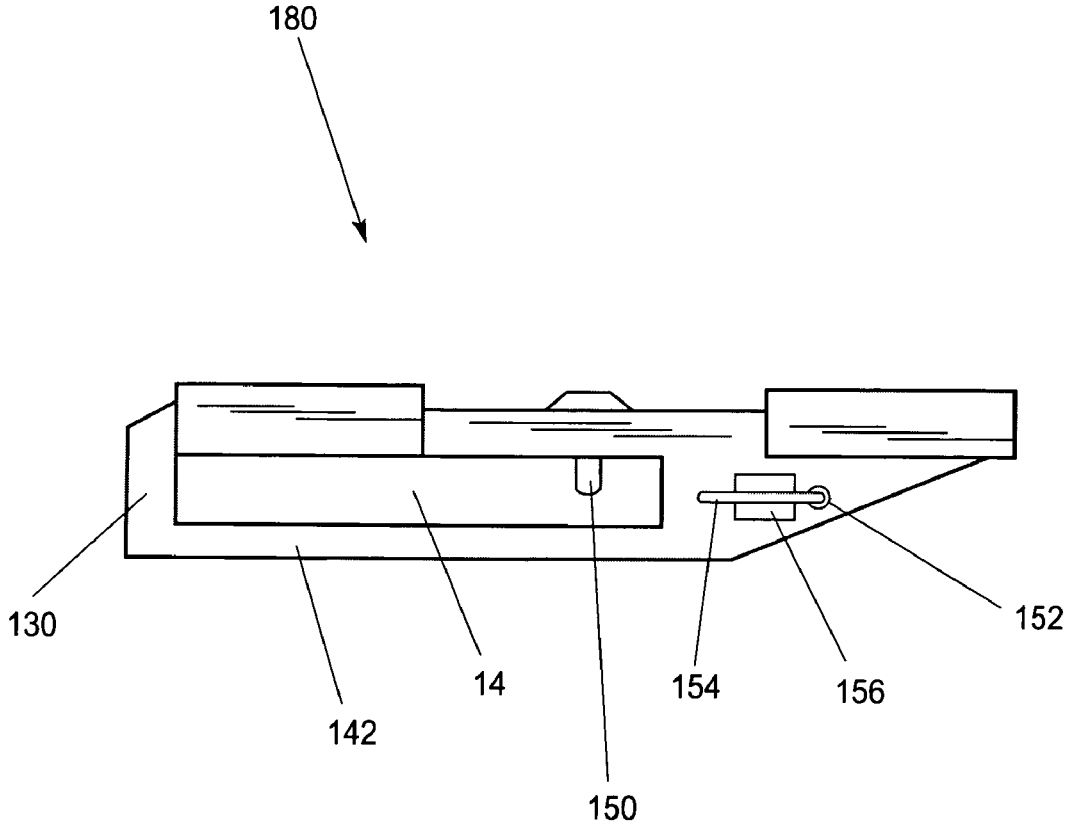
FIG. 11 is an end view of the belt mount component shown in FIG. 1D, depicting fastening elements of an embodiment of the present invention.

In another embodiment, shown in FIG. 11, mounting-plate 130 mounts there through at least one tensioner 150, such as a small screw, to secure the belt mount 180 to a user's belt. At least one similar tensioner (not shown) optionally may be disposed on base-plate 70 to adjust slack caused by wear. Preferably, a clip storage means or component 152 is disposed in mounting-plate 130 to house tool 154 (e.g. a small Allen wrench or screwdriver) useable to adjust tensioner 150 or any other tensioner provided. Storage component 152 may comprise any means known in the art, preferably a void with an opening and snap detents or prongs for holding tool 154 as depicted in FIG. 11. Tool 154 may comprise any tool known in the art such as, for example, a hex-shaped wrench. Also, adjacent to void 152, securing means 156 may be disposed to help secure tool 154 in place. Securing means 156 may be of any type known in the art such as, for example, a magnet.

Any fastening means, material, or method can be used to join the various components of the present invention such as, for example, pop-rivets, screws, bolts, glue, thermal bonding, epoxy, snap-together interfaces, and combinations thereof.

Figure 1C:
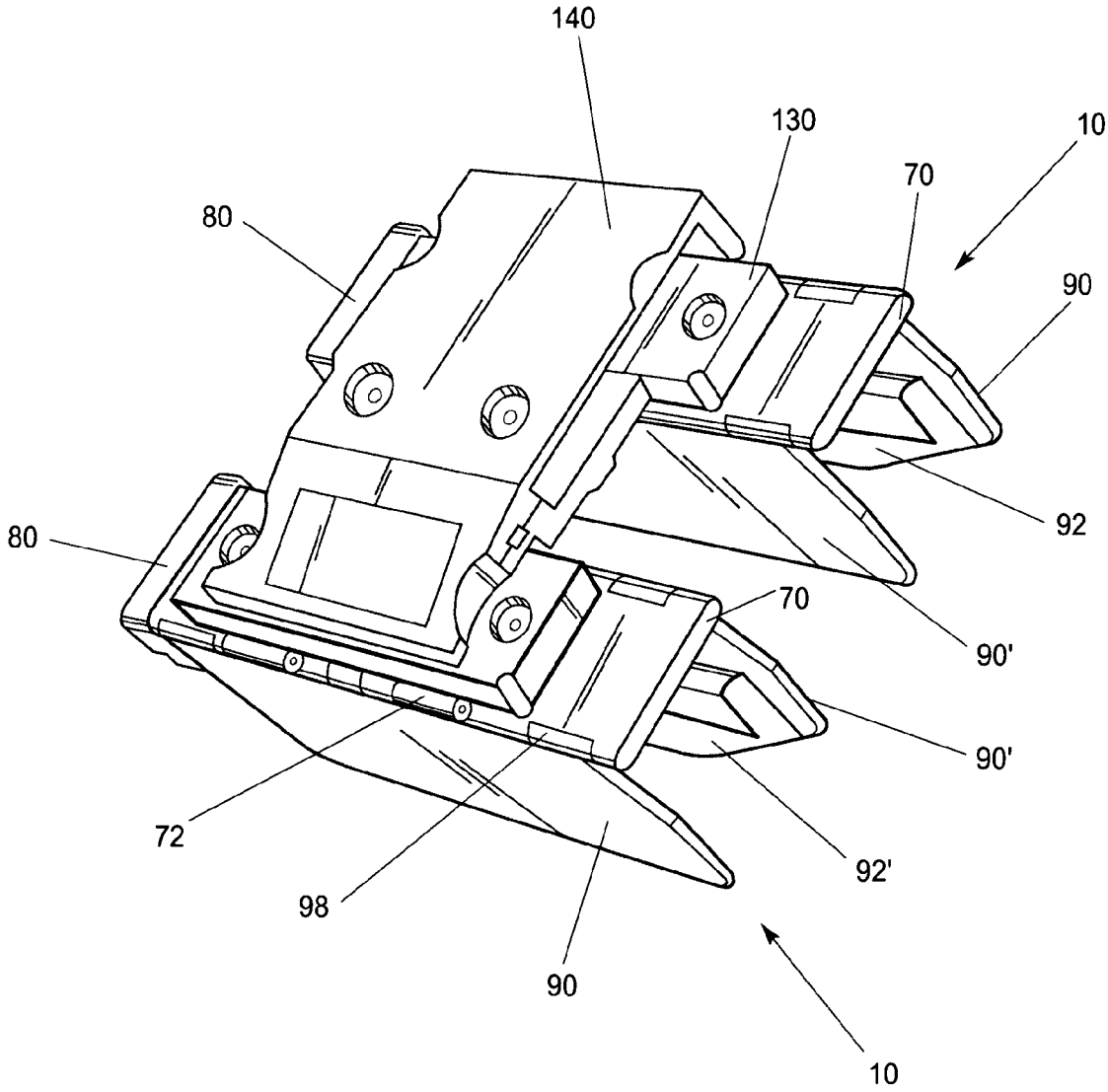
FIG. 1C is back perspective view of the embodiment of the apparatus shown in FIG. 1B.
Figure 1D:
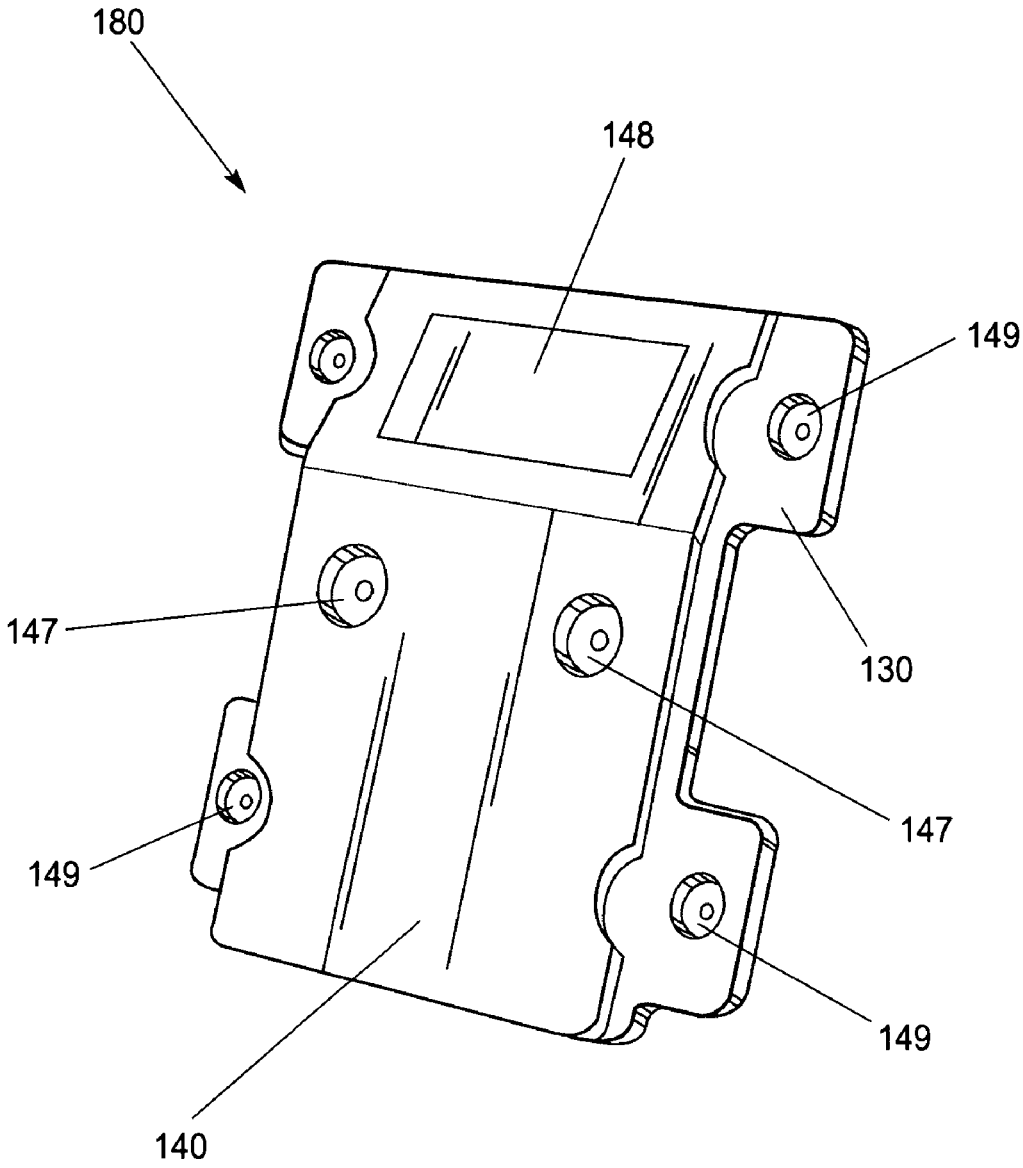
FIG. 1D is a back perspective view of a portion of the apparatus shown in FIG. 1C, depicting the mounting plate and loop plate of the apparatus, useable to removably suspend the apparatus upon a user's belt.

The method of the invention is apparent from the foregoing, but is further described especially with reference to FIGS. 1A, 1B, and 1C. The apparatus according to the invention is disposed upon the user's person, for example and preferably, by disposing the user's belt through belt opening 140 (shown in FIGS. 2 and 2A). Magazines 60 are securely but removably disposed in the housings 10 by being constrained intermediate to side-plates 90, 90', between base-plate 70 and lips 92, 92'. The preferred position for the removable insertion of the loaded magazine 60 into a housing 10 is with the floor-plate 20 adjacent the end plate 80 (FIG. 1A); such a position promotes the user's ability to grasp the magazine in the "index position" for rapid insertion, through habit developed by practice, into the firearm even in the dark or in an emergency. It will be apparent to one skilled in the art, however, that a loaded magazine 60 alternatively could be situated in the housing 10 in the reverse position, with the face-plate 20 adjacent the end of the housing opposite the end plate 80.

When the user has need for a spare magazine 60, he or she merely grasps floor-plate 20 and pushes or pulls it forward (i.e., away from end plate 80) and/or away from base-plate 70. Magazine 60 is free to slide within housing 10. Front portion 50 of floor-plate 20 contacts converging rear edges 93, 93' of lips 92, 92' so that with the user's continued forward movement of magazine 60, front portion 50 of floor plate 90, 90' contacts rear edges 93, 93' of lips 92, 92' and wedges them apart. As floor-plate 20 smoothly separates rear edges 93, 93', side-plates 90, 90' pivot outward against the urging of their respective springs 100. As side-plates 90, 90' pivot apart, floor-plate 20 slides past medial edges 96, 96', and magazine 60 is released from housing 10 and freed for insertion into the firearm. Once magazine 60 is fully withdrawn from housing 10, springs 110 bias side-plates 90, 90' toward each other until lips 92, 92' are restored to mutual contact (as seen in FIG. 1A) or in close proximity near contact (FIG. 1B).

Magazine 60, whether loaded or not, is inserted into housing 10 in much the same methodology, except in reverse process. The butt end of the magazine 60 is pressed into the area between front edges 94, 94' until floor-plate 20 comes into sliding contact with front edges 94, 94'. Magazine 60 is slipped into housing 10, generally parallel to base-plate 70, and floor-plate 20 serves as a wedge to separate lips 92, 92' to pivot side-plates 90, 90' apart. Floor-plate 20 slides along front edges 94, 94' and past intermediate edges 96, 96', until it moves between diverging rear edges 93, 93'. When the bottom of magazine 60 finally comes into flush contact with base-plate 70 (and floor-plate 20 is against end-plate 80), the side-plates 90, 90' pivot inward under the bias of springs 100. Lips 92, 92' swing into position immediately above (in or nearly in contact with) magazine 60. Magazine 60 thus is securely disposed within housing 10, with side-plates 90, 90' spring-biased toward magazine 60, until the user has need for magazine 60 at which time it can be readily retrieved as described previously above.

Alternatively, magazine 60 can be inserted in reverse fashion to that described above with the end of magazine 60 opposite floor-plate 20 being inserted to first contact rear edges 93, 93'. Magazine 60 is then pushed into housing 10 until magazine 60 snaps into place against base-plate 70 as floor-plate 20 passes over, and clears, end-plate 80.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. An apparatus comprising:

an ammunition magazine;

a housing comprising:

a base-plate;

two side-plates, at least a first one of said side-plates hingedly connected to said base-plate for pivotal movement from a rest position in relation to said base-plate;

means at an end of said housing for preventing said magazine from sliding out said end of said housing; and a spring in operative connection with said base-plate and said first one of said side plates to cause said first side-plate to resist a rotational force applied thereto in a direction away from the second side-plate; and a floor-plate attachable to said magazine and contactable with at least one of said side-plates;

wherein said side-plates are adapted to constrain said magazine there-between when said first one of said side-plates is in the rest position.

2. The apparatus of claim 1 wherein said magazine floor-plate comprises a large protruding front portion.

3. The apparatus of claim 1 wherein said magazine floor-plate defines an aperture disposed through said floor-plate.

4. The apparatus of claim 1 wherein at least one of said side-plates defines at least one recess on an inner surface thereof.

5. The apparatus of claim 1 wherein at least one of said side-plates comprises at least one projection disposed on an inner surface thereof.

6. The apparatus of claim 1 wherein said housing further comprises a lip extending laterally inward from said first side-plate toward said second side-plate.

7. The apparatus of claim 6 wherein said lip comprises an edge defining a longitudinal curve along at least a portion of the lip's length.

8. The apparatus of claim 1 wherein said lip comprises an edge defining a convex curve; and wherein:

while said magazine is being removed from said housing, a portion of said floor-plate slidably contacts said curved edge to pivot said first side-plate against the bias of said spring and away from said second side-plate; and while said magazine is being inserted into said housing, a portion of said floor-plate slidably contacts said curved edge to pivot said first side-plate against the bias of said spring and away from said second side-plate.

9. The apparatus of claim 1 comprising at least two of said housings disposed on a mounting-plate.

10. The apparatus of claim 1 wherein said spring biases said first side-plate toward the rest position.

11. The apparatus of claim 10 wherein when said first side-plate is in the rest position, said side-plates are substantially parallel.

12. The apparatus of claim 11 wherein when said magazine is constrained between said side-plates, said magazine is disposed between said lip and said base-plate.

13. An ammunition magazine retaining apparatus comprising:

at least one housing comprising a base-plate, an end-plate, and two side-plates, a first one of said side-plates connected to said base-plate and comprising a flexible material, whereby said first side-plate is elastically bendable in relation to said base-plate, and a lip extending laterally inward from said first side-plate toward the second said side plate, said lip having a rear edge and a front edge, said edges defining a convex curve longitudinally along at least a portion of the length of said lip;

an ammunition magazine removably insertable into said housing; and a floor-plate attachable to an end of said magazine;

wherein:

while said magazine is being removed from said housing. a portion of said floor-plate slidably contacts said rear edge of said lip to bend said first side-plate away from said second side-plate; and while said magazine is being inserted into the housing, a portion of the floor-plate slidably contacts said front edge of the lip to bend said first side-plate away from said second side-plate.

14. The apparatus of claim 13 comprising at least two housings disposed upon a mounting-plate.

15. The apparatus of claim 13 wherein said magazine floor-plate comprises a large protruding front portion.

16. The apparatus of claim 13 wherein said magazine floor-plate defines a fastener aperture there through for attaching said floor-plate to an end of said magazine.

17. An apparatus for releasably retaining ammunition magazines, the apparatus comprising:

a base;

a first side-plate extending from the base and hingedly connected to the base for pivotal relation thereto;

a second side-plate extending from the base;

spring means for biasing the first side plate to a rest position relative to the base;

a lip extending inward from an upper portion of the first side-plate and toward the second side-plate, the lip having a longitudinally convexly curved edge;

an ammunition magazine;

a magazine floor-plate attachable to an end of the magazine;

wherein the magazine is removably insertable between the side-plates, and further wherein:

while the magazine is being removed or inserted, a portion of the floor-plate slidably contacts the convexly curved edge of the lip to pivotally urge the first side-plate away from the second side-plate and against the bias of the spring means; and the magazine, when fully inserted between the side-plates, is retained between the side-plates and between the base and the lip.

18. An apparatus in accordance with claim 17 wherein the second side-plate is rigidly connected to the base.

19. An apparatus according to claim 18 wherein said second side-plate is integral with the base and extends substantially perpendicular therefrom.

20. An apparatus according to claim 17 wherein when the magazine is retained between the side-plates, said first side-plate is in the rest position and said side-plates are substantially parallel.

* * * * *